United States Patent [19]

Corry

[11] Patent Number: 4,460,437

[45] Date of Patent: Jul. 17, 1984

[54] LARRY CAR FOR A COKING OVEN BATTERY

[75] Inventor: David B. Corry, Blackpool, England

[73] Assignee: Otto-Simon carves Limited, Cheshire, England

[21] Appl. No.: 451,766

[22] Filed: Dec. 21, 1982

[30] Foreign Application Priority Data

Dec. 30, 1981 [GB] United Kingdom ..... 8139022

[51] Int. Cl.[3] ..... C10B 31/04; C10B 41/00

[52] U.S. Cl. ..... 202/262; 414/163

[58] Field of Search ..... 202/262, 263, 270; 414/152, 163, 200

[56] References Cited

U.S. PATENT DOCUMENTS

| | | | |
|---|---|---|---|
| 1,836,219 | 12/1931 | Wright | 414/163 |
| 2,057,125 | 10/1936 | Wilson | 202/263 |
| 3,374,151 | 3/1968 | Schmidt | 202/262 |
| 3,613,913 | 10/1971 | Kwappstein | 414/163 |
| 4,001,092 | 1/1977 | Pries | 414/163 |
| 4,369,094 | 1/1983 | Flockenhaus et al. | 202/262 |

FOREIGN PATENT DOCUMENTS 2060843 5/1981 United Kingdom .

*Primary Examiner*—Bradley Garris

*Attorney, Agent, or Firm*—LeBlanc, Nolan, Shur & Nies

[57] ABSTRACT

A larry car (3) for transporting a charge of pre-heated coal along the top of a battery of coke ovens, from a storage installation including a group of metering bins (1) at one or more filling stations above the battery, to a corresponding group of charge holes for the oven chamber to be charged, the car including a corresponding group of coal transfer hoppers (4) each having valved inlet and discharge apertures (5,21), a sealed connection (2) between each metering bin and transfer hopper, an inert gas reservoir (10) connectable via a valved manifold (13,14) to each transfer hopper, a valved connection (7,8,9) for charging the reservoir, and a valved connection (15,16,17) to permit dusty gas to be displaced into the storage bunkers, and control means for the various valved connections to maintain continuous isolation of the interior of each transfer hopper from the atmosphere, to permit dust-laden gases to escape into the storage installation, and to cause inert medium to displace coal discharged from the transfer hoppers.

6 Claims, 1 Drawing Figure

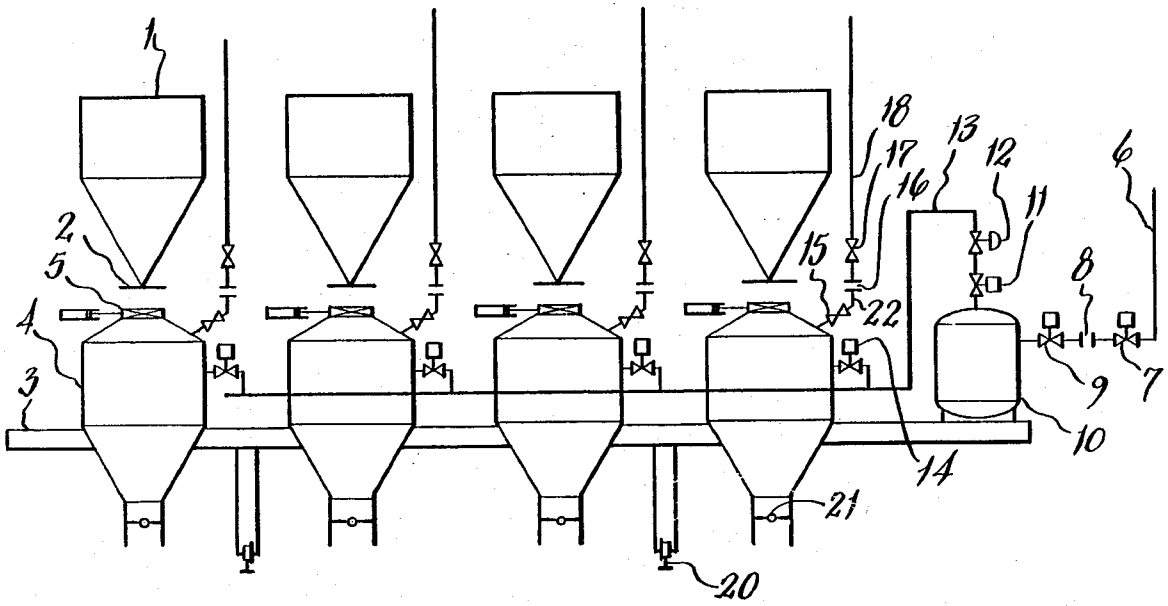
1
2
3
4
5
6
7
8
9
10
11
12
13
14
15
16
17
18
20
21
22

LARRY CAR FOR A COKING OVEN BATTERY

This invention concerns a larry car adapted to travel along the top of a battery of coke ovens to transport a charge of coal from a storage installation, usually at one end of the battery, to a position above an oven chamber to be charged.

Discharge of coal from the storage installation is via a group of metering bins arranged side-by-side and adapted to deliver a metered quantity of coal from a like number of storage bunkers, into a like number of transfer hoppers positioned on the larry car. When the hoppers are filled the car travels to the oven to be charged and there dispenses the coal into the oven chamber.

With the current practice of pre-drying and pre-heating coal for charging into coke ovens there is an environmental problem caused by the dusty nature of the pre-heated coal. The transfer of the pre-heated coal from the metering bins into the transfer hoppers of the larry car is by gravity through a dust-tight temporary connection. The dusty air displaced from the hoppers during filling is conventionally drawn through a vent pipe and ducted to a washer installation remote from the battery. When the hoppers are filled, and the car travels along the battery, the coal inlet and vent pipe are open to atmosphere, and critics of this system have claimed that, in windy conditions, there is an environmental hazard caused by dust blown into the atmosphere through these apertures. Additionally, the necessity for a land-based washer installation creates a disposal problem in the coal fines or sludge produced by the washing action. Furthermore, there is a risk of explosion in the hoppers by the displacement of air with pre-heated coal at the hopper filling station. If smouldering particles of coal are present in the hopper prior to filling, then the presence of air can cause ignition of an explosive mixture.

An object of the present invention is to provide a larry car designed and adapted, at least substantially, to overcome the disadvantages aforementioned.

According to the present invention there is provided a larry car for transporting a charge of pre-heated coal along the top of a battery of coke ovens from a storage installation including a group of metering bins at one or more filling stations above the battery, to a corresponding group of charge holes in the top of each individual oven chamber to be charged, the larry car including a corresponding group of coal transfer hoppers each having valved inlet and discharge apertures at the upper and lower ends respectively and characterised by means to establish a sealed connection, when the larry car is at said one or more filling stations, between the valved inlet of each hopper and the interior of said storage installation, means for supplying an inert medium to the interior of each hopper when the larry car is over an oven to be charged such that the inert medium displaces the coal discharged, and a plurality of valves and control means therefor to maintain continuous isolation of the interior of each hopper from the atmosphere.

An embodiment of the invention will now be described, by way of example, with reference to the accompanying schematic drawing illustrating the essential features of a larry car positioned beneath a group of metering bins of a storage installation.

Referring now to the drawing, the car 3 travels on rails 20 which extend along the top of a battery of coke ovens. The car supports four coal transfer hoppers 4 arranged side-by-side and adapted to receive a metered quantity of coal from a similar group of metering bins 1 forming the output stage of a storage installation for pre-heated coal. Storage bunkers (not shown) are arranged above the metering bins 1. The storage installation including the metering bins is disposed at one end of the battery of ovens, and the larry car is illustrated as being positioned beneath the metering bins prior to connection thereto. In known manner, a sealed connection 2 at the base of each metering bin is movable into position to form a sealed connection with the inlet aperture at the top of its associated transfer hopper on the larry car. A slide valve 5 serves as a closure or isolation valve for the inlet aperture. At the base of each transfer hopper is a discharge valve 21.

Connected to the interior of each hopper 4 is a vent pipe 22 having a shut-off valve 15, and a free end of the pipe 22, when the larry car is positioned below the metering bins, forms one part of a sealed connection 16 which is made by hydraulic actuators (not shown). The other part of the connection 16 is provided by the free end of a pipe 18 having therein a shut-off valve 17 and connected to the interior of the storage installation, usually the storage bunkers thereof.

Also connected to the interior of each transfer hopper 4, via individual shut-off valves 14, one for each hopper, is a manifold 13 which via a shut-off valve 11 and flow regulator 12 is connected to a storage reservoir 10 for an inert gaseous medium such as nitrogen or steam. Since the reservoir 10 is located on the larry car 3, an inlet pipe thereto having a shut-off valve 9 forms one part of a sealed connection 8, the other part of which is comprised by the free end of a supply pipe 6 for the inert medium, and having a shut-off valve 7 therein. Again, the sealed connection 8 will be made using hydraulic actuators.

In the operation of the system, with the larry car 3 positioned as illustrated beneath the metering bins and ready for the filling sequence to commence, sealed connections 2, 8 and 16 are closed whereupon valves 5, 15 and 17 are opened and the hoppers 4 are filled with a charge of pre-heated coal. As coal flows into the hoppers, dust laden gas therein is vented via the pipes 22 and 18 into the storage bunkers of the installation. Simultaneously, valves 7 and 9 are opened to charge the storage reservoir 10 with inert gas to a predetermined pressure, say 100 PSIG. The valve 11 remains closed during this operation.

When filling is complete valves 5, 7, 9, 15 and 17 are closed and seals 2, 8 and 16 are disconnected. Thus the larry car can travel to an oven chamber to be charged, as a totally enclosed unit, there being no risk of escape of dust or gas from any of the transfer hoppers 4.

When the car is positioned over an oven to be charged the base of each transfer hopper 4 is lowered in the usual way into sealed connection with the associated charge hole in the top of the oven. Thereafter, the discharge valves 21 are opened simultaneously or in sequence according to the required charging pattern, to permit coal to flow into the oven. When the first discharge valve 21 is opened, the isolation valve 11 is also opened together with the corresponding one of the valves 14 connecting the manifold 13 to the appropriate hopper. Thus as coal is discharged from the hopper it is replaced by inert gas from the reservoir 10. Thus, when all of the hoppers are discharged and the valves 21 are closed, the free spaces within the latter are fully occupied by the inert gas. The flow regulator 12 ensures that each hopper contains approximately the same volume of gas. Once the hoppers are filled with gas then the valves 11 and 14 are closed. It will be appreciated that by displacing the coal with gas under a certain positive pressure the discharge of coal is assisted thereby. Preferably, a low level indicator (not shown) is provided in the base region of each hopper to detect the moment when discharge is complete, and thus cause the associated valve 21 to close.

The larry car returns to the filling station with the hoppers filled with inert gas, and the cycle as described can be repeated.

The invention is not limited to the above example only, many variations, such as might readily occur to one skilled in the art, being possible without departing from the scope thereof.

For example, the four transfer hoppers 4 can be structurally joined together with an internal free passage or space ensuring the free transfer of gas between the hoppers. In this case, the manifold 13 can be connected to the interior of the hopper assembly at one position. Similarly, the vent pipes 22 can be replaced by a single vent connected to the hopper assembly and connectable to a single vent pipe leading to the storage bunkers.

Furthermore, the on-board storage reservoir 10 can be replaced by a fixed main extending alongside the oven battery with means on the larry car for connection thereto at spaced intervals corresponding to the oven chambers.

I claim:

1. A larry car for transporting a charge of pre-heated coal along the top of a battery of coke ovens from a storage installation including a group of metering bins at one or more filling stations above the battery, to a corresponding group of charge holes in the top of each individual oven chamber to be charged, the larry car including a corresponding group of coal transfer hoppers each having valved inlet and discharge apertures at the upper and lower ends respectively and characterised by means to establish a sealed connection, when the larry car is at said one or more filling stations, between the valved inlet of each hopper and the interior of said storage installation, means for supplying an inert medium to the interior of each hopper when the larry car is over an oven being charged, such that the inert medium displaces the coal discharged, means for releasing the inert medium from each hopper as said hopper is filled with said pre-heated coal at the filling station, such that the pre-heated coal displaces the inert medium, a plurality of valves and control means therefor to maintain continuous isolation of the interior of each hopper from the atmosphere, a vent pipe being connected to each said transfer hopper and including a valve to enable the interior thereof to be separately connected, for the passage of dust-laden gas, to the interior of said storage installation during transfer of pre-heated coal from the metering bins to said transfer hoppers, said control means being adapted to supply said inert medium to said transfer hoppers during discharge of pre-heated coal therefrom, and to discontinue said supply of inert medium after discharge.

2. A larry car according to claim 1, in which said inert medium supply means comprises a reservoir disposed upon said larry car and having a valved inlet for connection to means for supplying said inert medium, said reservoir having an outlet manifold and valved connections therefrom individually to said transfer hoppers.

3. A larry car according to claim 2, including a pressure regulator in said manifold to ensure that said transfer hoppers contain approximately equal volumes of inert medium.

4. A larry car according to claim 1, wherein said transfer hoppers are structurally joined together with an internal free passage for the free transfer of inert medium between the hoppers.

5. A larry car according to claim 1, wherein said inert medium supply means comprises means on the larry car for connection at spaced intervals to a fixed main extending alongside the oven battery.

6. A larry car according to claim 1, in combination with a coke oven battery and a storage installation for pre-heated coal comprising a fixed group of four metering bins disposed side-by-side at a filling station and adapted to receive from a like number of storage bunkers, equal quantities of pre-heated coal, the larry car carrying a corresponding group of four transfer hoppers adapted for sealed connection to said metering bins at said filling station, an inert medium supply reservoir mounted on said larry car and having means for connection to the interior of each said transfer hopper, the larry car adapted to travel along the top of a coke oven battery to each of a group of four charge holes of each oven chamber to be charged, the valved outlet of each transfer hopper being adapted for sealed connection to an associated one of said charge holes, and said control means for ensuring that the interior of each said transfer hopper is connectable only to the interior of said metering bins or to the interior of an oven chamber to be charged and said inert medium supply reservoir.

* * * * *